US005736030A

United States Patent [19]

Tsuchitani et al.

[11] Patent Number: 5,736,030

[45] Date of Patent: Apr. 7, 1998

[54] PROCESS FOR MANUFACTURING FINE PARTICLES OF PITCH WITH A HIGH SOFTENING POINT

[75] Inventors: Masatoshi Tsuchitani, Ichihara; Kiyotaka Suzuki, Sodegaura; Ryoichi Nakajima; Tomohiko Sato, both of Ichihara, all of Japan

[73] Assignee: Maruzen Petrochemical Co., Ltd., Tokyo, Japan

[21] Appl. No.: 565,116

[22] Filed: Nov. 30, 1995

[30] Foreign Application Priority Data

Dec. 7, 1994 [JP] Japan ..... 6-331132

[51] Int. Cl.[6] ..... C10C 1/00; C10C 3/00

[52] U.S. Cl. ..... 208/45; 208/39

[58] Field of Search ..... 208/39, 45

[56] References Cited

U.S. PATENT DOCUMENTS

| | | | |
|---|---|---|---|
| 3,786,134 | 1/1974 | Amagi et al. | 423/449 |
| 4,209,500 | 6/1980 | Chwastiak | 423/447.6 |
| 4,243,512 | 1/1981 | Seo et al. | 208/39 |
| 4,363,670 | 12/1982 | Noguchi et al. | 106/278 |
| 4,522,627 | 6/1985 | Gomi et al. | 208/39 |
| 4,789,455 | 12/1988 | Mochida et al. | 208/39 |
| 4,820,401 | 4/1989 | Tsuchitani et al. | 208/40 |
| 4,863,708 | 9/1989 | Seo et al. | 423/447.2 |
| 4,891,126 | 1/1990 | Mochida et al. | 208/39 |
| 5,091,072 | 2/1992 | Tsuchitani et al. | 208/39 |

OTHER PUBLICATIONS

Derwent Publication----JP 85059950 Dec. 9, 1985 Japanese Patent Publication No. Sho 60(1985) 59950.

Derwent Publication----JP 85002352 Japanese Patent Publication No. Sho 60(1985)----2352.

Derwent Publication----JP 85030364 Japanese Patent Publication No. Sho 60(1985)----30364.

Derwent Publication----JP 89044750 Japanese Patent Publication No. Hei 1 (1989)----44750.

Derwent Publication----JP 1138223 Japanese Patent Laid-open No. Hei. 1(1989) 138223.

Derwent Publication----JP 61028020 Japanese Patent Laid-open No. Sho 61 (1986) 28020.

Derwent Publication----JP 61289134 Japanese Patent Laid-open No. Sho 61(1986) 289134.

Derwent Publication----JP 55098914 Japanese Patent Laid-open No. Sho 55 (1980) 98914.

Derwent Publication----JP 1141985 Japanese Patent Laid-open No. Hei 1 (1989) 141985.

Derwent Publication----JP 61083239 Japanese Patent Laid-open No. Sho 61(1986) 83239.

Derwent Publication----JP 5148489 Japanese Patent Laid-open No. Hei 5 (1993)----148489.

Derwent Publication----JP 1081890 Japanese Patent laid-open No. Hei 1(1989)----81890.

Derwent Publication----JP 94035581 Japanese Patent Publication No. Hei 6(1994)----35581.

Derwent Publication----JP 75039633 Japanese Patent Publication No. Sho 50 (1975)----39633.

Derwent Publication----JP 94035582 Japanese Patent Publication No. Hei 6 (1994)----35582.

*Primary Examiner*----Helane Myers

*Attorney, Agent, or Firm*----Melvin L Stoltz

[57] ABSTRACT

A process for manufacturing fine particles or powder of pitch with a high softening point from a heavy oil raw material which is liquid at an ambient temperature or pitch having a relatively low softening point is disclosed. Fine particles of pitch with a high softening point are useful materials and can be used as carbon materials for various applications. A characteristic feature of the process resides in the utilization of emulsion of the heavy oil raw material. That is, it is disclosed a process for manufacturing fine particles of pitch with a high softening point comprising, a first step of stirring a raw material heavy oil in the presence of a surface-active agent and water by a stirring method which can provide a shearing force to produce an emulsion of fine spherical pitch particles dispersed in water, wherein the raw material heavy oil is a liquid having a viscosity of 1,000 poise or less at the stirring condition; a second step comprising causing the emulsion obtained in the first step to come in contact with an extracting organic solvent to extract and remove light components from the fine spherical particles in the emulsion, thereby obtaining fine particles of pitch with an increased softening point; and a third step comprising separating and recovering fine particles of pitch with an increased softening point.

18 Claims, 3 Drawing Sheets

10 μ

PROCESS FOR MANUFACTURING FINE PARTICLES OF PITCH WITH A HIGH SOFTENING POINT

BACKGROUND OF THE INVENTION

1. Field of the Invention

The present invention relates to a process for manufacturing fine particles or powder of pitch with a high softening point (such fine particles or powder are hereinafter collectively called "fine particles") from a heavy oil raw material, such as petroleum-type, coal-type or synthetic heavy oil which is liquid at an ambient temperature or pitch having a relatively low softening point (such heavy oil materials or pitches are hereinafter called "raw material heavy oil(s)").

Fine particles of pitch with a high softening point can be used as a carbon material for various applications, a material for carbon/carbon (C/C) composites, and a binder for refractory bricks and the like. The research for the improvement of characteristics of these end products is being actively undertaken in recent years. A most important factor for the improvement of these characteristics is to homogeneously disperse carbon particles or carbon fibers and the fine particles of pitch with a high softening point used as a binder in forming the end products. Another important factor is to increase the yield of carbon based on the pitch used as the binder.

In addition, various other applications of fine particles of pitch with a high softening point are investigated. In these applications the fine particles of pitch are rendered infusible, and carbonized or graphitized to produce carbon or graphite particles. Then, these particles are used as carbon fillers, fillers for composite materials, materials for giving conductivity to resins, dispersion particles for electro rheological fluids, the cathode-material for lithium ion secondary battery, the fillers and adsorbents for high-performance liquid chromatography (HPLC), and the like. The characteristics, such as superior dispersibility, excellent filling property, a large surface area, a high reaction rate, and a high adsorption rate, are desired also for carbon particles used for these applications.

A process capable of efficiently manufacturing the fine particles of pitch with a high softening point which can be used suitably for these various applications is also desired.

2. Description of the Prior Art

Conventionally, a number of processes for manufacturing fine particles of pitch with a high softening point have been known. Many of these processes are a combination of a conventional method for producing pitch with a high softening point and a conventional method for making fine particles from the pitch.

Conventionally known methods for producing pitch with a high softening point include: (1) a method of treating heavy oil at a high temperature in the range of 350°–500° C. (e.g. U.S. Pat. Nos. 4,243,512, 4,209,500), (2) a combination of heat treatment and solvent extraction (e.g. Japanese Patent Publication No. Sho 60(1985)-59950), (3) a combination of hydrogenation and heat treatment (e.g. Japanese Patent Publication No. Sho 60(1985)-30364, No. Sho 60(1985)-30362, Hei 1(1989)-44750), (4) a combination of solvent extraction, hydrogenation and heat treatment (e.g. U.S. Pat. No. 4,820,401), (5) a method of polymerizing naphthalenes with a super strong acid and removing light fractions from the polymerized product (e.g. U.S. Pat. Nos. 4,789,455, 4,891,126), (6) a method of polymerizing naphthalenes with a Lewis acid and removing light fractions from the polymerized product (e.g. Japanese Patent Laid-open No. Hei 1(1989)-138223, U.S. Pat. No. 4,863,708), (7) a method of oxidatively polymerizing a low softening point pitch with air, oxygen, or ozone and heat treating the polymerized product (e.g. Japanese Patent Laid-open No. Sho 61(1986)-28020 and No. Sho 61(1986)-289134), and (8) a method of polymerizing a pitch using a polymerization accelerator and heat treating the polymerized product (e.g. Japanese Patent Laid-open No. Sho 55(1980)-98914 and No. Hei 1(1989)-141985).

The above methods (1) and (2) require a treatment at a high temperature which involves a problem of coking. It is difficult to operate the production plant in a stable manner for a long period of time. The methods (3) and (4) require a large investment for the production plant. The methods (5)–(8) require use of special catalysts which must be removed or recovered from the product. The problem in these method is a high cost involved in the removal and recovery of the catalysts.

Various methods have been conventionally known for making fine particles from pitch. Typical methods are (i) to mechanically pulverize pitch with a high softening point by a dry or wet method, (ii) to melt pitch with heat, inject the melted pitch together with a high temperature gas, and quench the injected fine particles of pitch (e.g. Japanese Patent Laid-open No. Sho 61(1986)-83239, No. Hei 5(1993)-148489), or optionally to add inorganic powder to the surface of the particles when quenching (e.g. U.S. Pat. No. 4,522,627), and (iii) to pulverize pitch and heat the pulverized pitch at a temperature above the softening point in a high boiling point dispersion medium such as silicone oil to make fine particles of pitch (e.g. Japanese Patent Laid-open No. Hei 1(1989)-81890, Japanese Patent Publication No. Hei 6(1994)-35581).

The dry pulverization in the method (i) above is only applicable to pitch with a sufficiently high softening point, because the pitch particles may fuse together due to the heat and pressure of pulverization. The wet pulverization requires a long time to pulverize the pitch and yet sometimes produces roughly pulverized large-size particles. Among the methods (ii), the method of injecting pitch together with a hot gas entails a difficulty in quenching the particles before the particles do not get together. Usually, agglomerated large particles result. The modification to add inorganic powder while the particles are being quenched has a drawback in that the product cannot be used for the application in which the presence of the inorganic powder is undesirable. The method (iii) also has the problems that a part of pitch is dissolved in the dispersion medium and cannot be recovered, the dispersion medium is rapidly deteriorated, and the like.

As described above, in the conventional processes for manufacturing fine particles of pitch with a high softening point, the pitch with a high softening point is first produced by one of the above methods from petroleum heavy oil, heavy oil derived from coal, or synthetic heavy oil. This pitch with a high softening point is then made into fine particles by any one of the above methods. The aforementioned various problems involved in the methods for manufacturing pitch and the methods for making fine particles from the pitch are unavoidable in these processes. The processes need treatments at high temperatures and require a high investment cost for the facilities. No processes could manufacture fine particles of pitch with a high softening point efficiently and easily at a low cost.

A process for manufacturing fine particles of pitch with a high softening point which comprises producing mesophase spheres from heavy oil by a heat treatment at 350°–500° C., and separating the mesophase spheres as solvent insoluble matters has been also conventionally known (e.g. Japanese Patent Publication No. Sho 50(1975)-39633, U.S. Pat. No. 4,363,670, Japanese Patent Publication No. Hei 6(1994)-35582). These processes also require a heat treatment at a high temperature and have a problem that the mesophase spheres are easily get together to form bulk mesophase. It is impossible to increase the concentration of mesophase spheres in the heat-treated pitch. These processes also could not manufacture fine particles of pitch with a high softening point efficiently and easily at a low cost. In addition, the product obtained by these processes after the solvent extraction is very close to carbon in its properties and cannot be melted with heat.

SUMMARY OF THE INVENTION

Accordingly, an object of the present invention is to provide a process for manufacturing fine particles of pitch with a high softening point, in which the above-described various problems associated with the heat treatment of pitch at high temperatures, i.e methods (1)–(8), and with the methods of making fine particles from the pitch, i.e. methods (i)–(iii), or with the methods utilizing the production of mesophase have been overcome and which can manufacture fine particles of pitch with a high softening point industrially efficiently and easily at a low cost.

Other objects of the present invention will be apparent to those in the art from the detailed descriptions and examples given hereunder.

We have conducted extensive research relating to the manufacture of pitch with a high softening point, the manufacture of mesophase spheres by a heat treatment of pitch and extraction, and the method of making fine particles from pitch with a high softening point. In the course of the research, we realized that it is difficult to solve the aforementioned various problems if one continued to stick to a conventional processes; that is, the processes comprising manufacturing pitch with a high softening point which involves a heat treatment at a high temperature, followed by making the pitch into fine particles. We continued the studies from a new viewpoint and have found that it is possible to produce fine particles of pitch with a high softening point very efficiently and easily at an industrial scale by means of a process comprising firstly, making fine particles of the raw material heavy oil by a specific method and then secondly, subjecting the fine particles of raw material heavy oil to a specific treatment to increase the softening point without unduly changing the size and shape of the particles. This finding has led to the completion of the present invention.

Thus, the gist of the present invention resides in a process for manufacturing fine particles of pitch with a high softening point comprising, a first step of stirring a raw material heavy oil in the presence of a surface-active agent and water by a stirring method which can provide a shearing force to produce an emulsion with fine spherical particles with a particle size of 100 μm or less dispersed in water, wherein the raw material heavy oil is a liquid having a viscosity of 1,000 poise or less when stirred; a second step comprising causing the emulsion obtained in the first step to come in contact with an extracting organic solvent which can dissolve water and capable of leaving at least 10% by weight of the raw material heavy oil as an insoluble portion to extract and remove light components and a diluting organic solvent, if the diluting organic solvent exists, from the fine spherical particles of the raw material heavy oil in the emulsion, thereby converting fine particles of the raw material heavy oil to fine particles of pitch with an increased softening point; and a third step comprising separating and recovering fine particles of pitch with an increased softening point by a solid-liquid separation means from the liquid mixture of the emulsion and the extracting organic solvent obtained in the second step.

An embodiment of the present invention is a process for manufacturing fine particles of pitch with a high softening point comprising, a first step of stirring a raw material heavy oil in the presence of a surface-active agent and water by a stirring method which can provide a shearing force to produce an emulsion with fine spherical particles with a particle size of 100 μm or less dispersed in water, wherein the raw material heavy oil is a liquid having a viscosity of 1,000 poise or less when stirred or, otherwise, conditioned to become a liquid with a viscosity of 1,000 poise or less by a method of heating, a method of diluting or dissolving with a diluting organic solvent which is mutually insoluble with water and capable of dissolving 90% by weight or more of the raw material heavy oil, or a combination of these two methods; a second step comprising causing the emulsion obtained in the first step to come in contact with an extracting organic solvent which can dissolve water and capable of leaving at least 10% by weight of the raw material heavy oil as an insoluble portion to extract and remove light components, and also to extract and remove the diluting organic solvent, when the raw material heavy oil is conditioned by dilution or dissolution using the diluting organic solvent in the first step, from the fine spherical particles of the raw material heavy oil in the emulsion, thereby converting fine particles of the raw material heavy oil to fine particles of pitch with an increased softening point; and a third step comprising separating and recovering fine particles of pitch with an increased softening point by a solid-liquid separation means from the liquid mixture of the emulsion and the extracting organic solvent obtained in the second step.

According to the process of the present invention, raw material heavy oils are converted into fine particles by using a method to make an emulsion prior to converting the raw material heavy oils into high softening point pitches. Therefore, according to the process of the present invention, fine particles of the pitches with a high softening point can easily be prepared without encountering any difficulties mentioned previously relative to known conventional processes. Further, in the process of the present invention, conversion of the raw material heavy oils into high softening point pitches is conducted by extracting and removing lighter components from the fine particles of raw material heavy oils in a state of emulsion with an extracting organic solvent. Accordingly, by the process of the present invention, raw material heavy oils can easily be rendered into high softening point pitches without any troubles encountered in the conventional processes. That is, when preparing high softening point pitches in the conventional processes, a heat treatment is indispensable. Incidentally, hithertofore, high softening point pitch or asphalt emulsions per se were known. Also, high softening point pitch and asphalt fine particles per se were known. For example, U.S. Pat. No. 3,786,134 discloses a process for preparing fine hollow particles of a pitch by dispersing an organic solvent solution of the pitch into water in the aid of a protective colloid, dehydrating and drying the dispersion, to obtain fine particles, and then rapidly heating the fine particles to vaporize light fractions and solvents contained therein thereby forming fine hollow particles. It was also known to make an emulsion of asphalt and using the emulsion thus prepared as a fuel. It was also known to obtain stabilized fine particles of asphalt by adsorbing powder of an inorganic material onto the fine particles contained in the emulsion and collecting the fine particles as an asphalt powder. However, utilization of an emulsion of raw material heavy oils for the production of fine particles of pitches with higher softening point than the raw material heavy oils was not yet reported. We have conducted many extensive studies to develope a meritorious process for the production of fine particles of pitches with higher softening point than the raw material heavy oils and as described above, the present invention was completed by a selection of entirely novel idea when compared to conventional processes for the preparation of fine particles of pitches with high softening points.

DETAILED DESCRIPTION OF THE INVENTION

Figure 1:
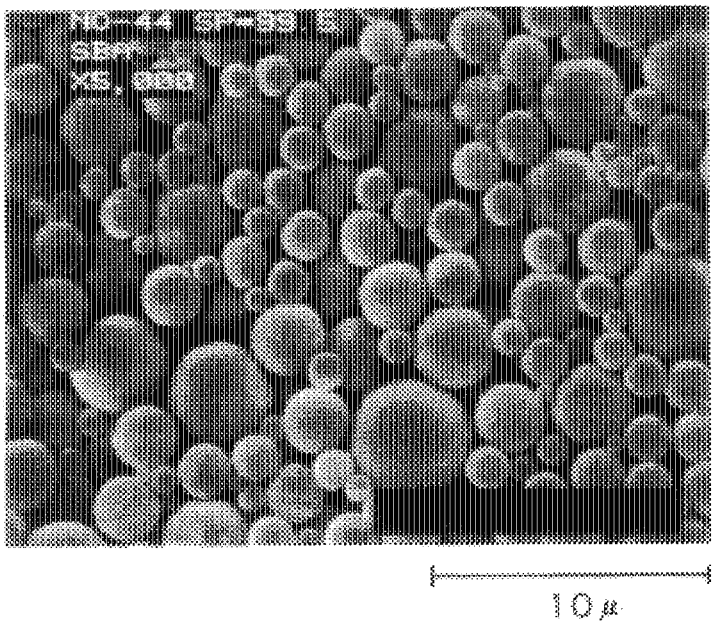
FIG. 1 is a scanning electron microscopic photograph of the fine spherical particles of pitch with a high softening point obtained by the use of SBA as the extracting solvent in Example 1. Incidentally, the length of the segment shown below the photograph corresponds to 10 μm.

In the followings, the present invention will be described in more detail.

As the raw material heavy oils usable in the present invention include many kinds of materials and are illustrated below. As raw materials of petroleum origin, asphalts obtainable by distillation of crude oils, modified asphalts, e.g. blown asphalts which are obtainable by air-blowing of asphalts, heavy oils obtainable by fluid catalytic cracking (FCC) of petroleum fractions (usually called decant oils or FCC slurry oils), heavy oils obtainable by naphtha crackings (usually called naphtha cracking tars or simply called naphtha tars), heavy oils obtainable by gas oil crackings (usually called pyrolysis tars), and the like can be cited. As raw materials of coal origin, coal tars obtainable by dry distillations of coals, modified coal tars obtainable by distillation, extraction, hydrogenation, heat treatment, etc. of coal tars, and liquefied coals obtainable by hydrogenation of coals and the like can be cited. Synthetic heavy oils such as tar like materials obtainable by heat treatment or catalytic polymerization of organic compounds can also be used as the raw materials. Further, pitches which are solid at normal temperature, obtainable by distillation, extraction, hydrogenation, heat treatment, etc. of heavy oils of petroleum origin, heavy oils of coal origin and synthetic heavy oils mentioned above can also be used. Still further, a pitch which is solid at normal temperature, obtainable by polymerization of naphthalenes with super strong acids or Lewis acids can be used as raw material of the present invention, too. It is also possible to use as a raw material of the present invention, a pitch which is solid at normal temperature, obtainable by polymerizing alkyl-substituted aromatic compounds with formaldehyde in the presence of acid catalysts and then heat treating the polymerized materials. In conclusion, any pitches of petroleum origin, coal origin and synthetic origin can be used in the process of the present invention. Any mixtures of the heavy oils and/or the pitches can also be used.

When the raw materials are pitches, it is preferable that the pitches have a softening point of not higher than 150° C. and more preferably not higher than 120° C. The term "softening point" used in the present invention means a softening point determined by a temperature gradient method which can be measured by the process and apparatus mentioned below. The softening point was determined by heating a long and narrow aluminum plate with a temperature gradient along the length, placing the sample powders along the plate, brushing lightly off the samples and measuring the temperature of the spot where the samples begin to adhere. The apparatus used is a product of Asia Rikaki KK, AMK-B2CEFH-3. Softening point measured by temperature gradient method is approximately 15°–20° C. lower than the softening point measured by JIS Ring and Ball (R & B) method and approximately 25°–50° C. lower than the softening point measured by Mettler method. Of course, the corelations mentioned above are helpful only to estimate R & B softening point or Mettler softening point and the differences between the softening point used in the present invention and R & B softening point or Mettler softening point can vary depending on the kind, origin, and properties of the pitches. Only limited processes can produce a pitch with a softening point of above 150° C. That is to say, the raw material heavy oils must be distilled or heat-treated at high temperatures, must be heat-treated using sophisticated equipment such as a thin film evaporator, or must be polymerized using an expensive catalyst. These treatments not only accompany a high production cost, but also can only be performed in an unstable manner due to coking troubles depending on the kind of the raw material heavy oil or depending on the softening point which is targeted. According to the present invention, however, there is no need to use the pitch with a high softening point as the starting raw material for the first step, because the softening point of the pitch is increased in the second step.

In the first step of the present invention, a raw material heavy oil, as a liquid with a viscosity of 1,000 poise or less, preferably 800 poise or less, is stirred in the presence of a surface-active agent and water by a stirring method which can provide a shearing force to produce an emulsion with fine spherical particles with a particle size of 100 μm or less.

Any known equipment can be used for the emulsification treatment in the first step. Various methods which can provide an adequately strong shearing and agitation force can be applicable. Examples of such methods include mechanical stirring, ultrasonic dispersion, a combination of the mechanical stirring and ultrasonic dispersion, a method using a high rotation homogenizer, a method of mixing and dispersing by circulation while injecting the mixture from nozzles at a high pressure, and a method of using a mixer or the like with shearing and pulverizing functions such as a colloid mill. Either batch or continuous equipment can be used.

In order to produce a stable emulsion by the emulsification treatment from a raw material heavy oil in the presence of a surface-active agent, it is necessary to disperse the raw material heavy oil with a particle size of 100 μm or less in water. For this purpose the raw material heavy oil must be a liquid state with an adequately low viscosity at the treating temperature. Although the viscosity required for the raw material heavy oil is different depending on the shearing force, torque, and the like of the equipment for the emulsification, the raw material heavy oil with a viscosity of 1,000 poise or less can well produce fine particles with a size of 100 μm or less by using equipment with a large shearing force, such as an agitator with large blades, a circulation mixing-dispersion device while injecting the mixture from nozzles at a high pressure, or a colloid mill. When equipment such as a stirrer with a small torque or a ultrasonic washer is used, it is desirable to decrease the viscosity as low as possible or less than several tens of poise. The appropriate viscosity of the raw material heavy oil is therefore determined depending on the equipment used for the emulsification treatment.

When the raw material heavy oil is a liquid and has a viscosity of 1,000 poise or less at ambient temperatures, the heavy oil can be suitably emulsified as is by the treatment at a temperature near the ambient temperatures.

When the raw material heavy oil is a viscous liquid having a viscosity greater than 1,000 poise at ambient temperatures or a pitch-like material which is solid at ambient temperatures, the viscosity must be decreased to 1,000 poise or less at the emulsification treatment either (a) by heating the raw material when it is emulsified, that is, by increasing the temperature of the emulsification treatment, or (b) by diluting the raw material with a diluting organic solvent or dissolving it with the diluting organic solvent.

When the method of heating (a) is applied to the adjustment of viscosity, if the heating temperature, i.e. the treating temperature, is below the boiling point of water, the emulsification can be carried out at atmospheric pressure. If the heating temperature is above the boiling point of water, the emulsification is carried out under pressure sufficient to keep the water in a liquid state. For example, when the raw material heavy oil is a pitch which is solid at ambient temperatures and when the viscosity of this pitch is to be decreased to 1,000 poise or less, it is generally desirable to heat the pitch to a temperature at least 40° C. higher than the softening point which was previously defined above in this specification (temperature gradient method). That is to say, if the softening point of the pitch is 60° C. or higher, it is desirable to heat the pitch to a temperature of 100° C. or higher. The emulsification can be carried out at this temperature under a pressure sufficient to keep water in a liquid state.

When the method (b), the method to dilute or dissolve the raw material heavy oil with a diluting organic solvent, is employed, such an organic solvent may be, for example, those mutually insoluble with water and capable of dissolving 90% by weight or more of the raw material heavy oil. Specific examples include aromatic hydrocarbon solvents, such as benzene, toluene, xylene, and ethylbenzene; chlorine-containing solvents such as, carbon tetrachloride, chloroform, and trichloroethylene; low molecular weight components in the raw material heavy oil, such as tar gas oil or carbonyl oil in coal tar; and cracked gasoline or gas oil fractions produced by naphtha cracking.

If the diluting organic solvent is mutually soluble with water or has an affinity with water, the organic solvent tends to move to water when the raw material heavy oil diluted with or dissolved in the organic solvent is emulsified in water. This unduly increases the viscosity of the raw material heavy oil and makes it difficult to disperse droplets of the raw material heavy oil with a diameter of an order of micron meter. For example, a nitrogen-containing polar solvent such as quinoline and pyridine, which is incompletely soluble mutually with water but dissolved in water to a certain extent, dissolves the raw material heavy oil very well by themselves. But, when this solution is added to water, some amount of the solvent is transferred to water and the solution of the raw material heavy oil becomes highly viscous. Droplets of the raw material heavy oil thereby produced are almost indispersible in water or, in the case where the torque of the stirrer is small, the droplets may agglomerate into a lump and stop the stirring operation.

A pitch with an extremely high softening point, e.g. about 200° C. or higher, generally contains a large amount of high molecular weight components produced by the heat treatment when the pitch is manufactured. Many of these high molecular weight components are not soluble in the organic solvents which are mutually insoluble in water used for diluting or dissolving the raw material heavy oil in the above-described method (b). Even if dissolved, such a high softening point pitch produces a large amount of precipitate of solid insoluble components and cannot be easily emulsified. Further, to decrease the viscosity of this type of high softening point pitch is also difficult by the application of the method of heating (a). It is necessary that such pitch must be heated to an extremely high temperature to make it liquid of a desired viscosity, and the application of the process of this invention is thus practically difficult in most cases. It is therefore undesirable to use such a high softening point pitch as the raw material heavy oil. The pitch used as the raw material heavy oil should preferably has a solubility of 90% by weight or more to the organic solvent used in the first step.

The blending ratio of the raw material heavy oil and the organic solvent in the method (b) of diluting or dissolving the former with the latter varies depending on the properties of the raw material heavy oil used, for example, the viscosity, the softening point, and the like. Because the viscosity of the organic solvent is sufficiently low, it is possible to decrease the viscosity of the mixture to a desired level at the treating temperature without using a large amount of the organic solvent. Use of too large amount of the organic solvent results in a large amount of the mixture to be treated and decreases the economy. Although a specific proportion depends on the kind of the raw material heavy oils, the use of the organic solvent in an amount of usually not more than one part by weight for one part by weight of the raw material heavy oil is sufficient. Many raw material heavy oils have a specific gravity of greater than 1, and therefore, the method (b) is advantageous from the aspect of ensuring stable dispersion of the emulsion, because to stabilize the dispersion it is possible to use the organic solvent with a specific gravity smaller than 1 and thereby to reduce the specific gravity of the solution of the raw material heavy oil close to 1, i.e., the specific gravity of water. In addition, it is possible to easily adjust the viscosity of the solution of the raw material heavy oil to a desired level of 1,000 poise or less by controlling the ratio of the raw material heavy oil and the organic solvent. This is also the advantage of the method (b). Raw material heavy oils, e.g. pitches which are highly viscous or solid at ambient temperatures can be easily emulsified by means of this method.

As required, it is possible to use a method (c) which is a combination of said method of heating (a) and the method of diluting or dissolving with organic solvent (b). For example, the viscosity of a raw material heavy oil which must be heated to 100° C. or above to obtain a liquid with a desired viscosity by the use of method (a) alone can be very easily and remarkably decreased at a lower temperature by the combined use of the method (b). In this case, however, the treating pressure should be selected taking into account the boiling point of the solvent used and the treating temperature.

In the above, it is stated as if method (a), (b), or (c) is used when the raw material heavy oil is a solid or has a viscosity higher than 1,000 poise at an ambient temperature, but it is apparent that the method (a), (b), or (c) is also applicable even if the raw material heavy oil has a viscosity of 1,000 poise or less at an ambient temperature.

The raw material heavy oil is fed to the first step after the adjustment of the viscosity to 1,000 poise or less, a viscosity suitable for the emulsification treatment, by the use of the above-mentioned method (a), (b), or (c), as required. The temperature for the emulsification treatment is arbitrarily selected from the range in which the raw material heavy oil is kept liquid with a desired viscosity. The treating pressure can be also selected from the range in which water which is the dispersion medium, as well as the organic solvent, in the case where such an organic solvent is used in the method (b) or (c) to adjust the raw material heavy oil, are kept liquid at the treating temperature. Both the treating pressure and the treating temperature as low as possible are desirable in view of the economy and easiness of operation of the equipment for the emulsification treatment.

In the first step emulsification treatment, the viscosity of the raw material heavy oil greatly affects the particle size of the resulting fine spherical droplets. Normally, the particle size is small when the viscosity is low. As a typical example, Table 1 shows a relationship found in viscosities of benzene solutions of a pitch with a softening point of 71° C. (Metler softening point: 99.5° C. ), obtained by the distillation of naphtha cracked by-product tar, dissolved in various quantities of benzene, and the maximum size of the emulsion particles prepared from these benzene solutions of pitch and 200 ml of an aqueous solution of 2% by weight a nonionic surface-active agent (Emulgen 985: tradename, manufactured by Kao Corp.) using a homogenizer (POLYTRON PT45-80: tradename, manufactured by Kinematica Co.) at 5,000 rpm.

TABLE 1

| Benzene/pitch (weight ratio) | Viscosity at 25° C. (poise) | Maximum particle diameter (μm) |
|---|---|---|
| 50/50 | 0.13 | 5 |
| 40/60 | 0.64 | 10 |
| 30/70 | 9.75 | 40 |

In the case where this same pitch melted by the method of heating (a) to a desired viscosity is emulsified under pressure, the lower the viscosity of the melted pitch, the smaller the particle size of the spherical droplets in the resulting dispersion.

Because the raw material heavy oil has only poor affinity with water, the use of a surface-active agent is indispensable to disperse fine spherical particles of the raw material heavy oil in water in the first emulsification treatment step. Various commercially available surface-active agent can be used for this purpose. Specific example include cationic surface-active agent, such as salts of fatty acids, alkyl sulfates, alkylbenzene sulfonates, alkylnaphthalene sulfonates, dialkylsulfosuccinates, alkyl phosphates, alkylether sulfates, formalin condensate of naphthalene sulfonic acid, and alkylether phosphates; anionic surface-active agent, such as salts of alkylamine and quaternary ammonium salts; and nonionic surface-active agent, such as polyoxyethylene alkyl ethers, polyoxyethylene alkylphenylethers, polyoxyethylene polyoxypropylene block copolymers, sorbitan fatty acid esters, polyoxyethylene sorbitol fatty acid esters, polyglycerine fatty acid esters, polyoxyethylene fatty acid amides, and polyoxyethylene alkylamines.

The surface-active agent used for a particular raw material heavy oil is selected from the one which exhibits good affinity and compatibility with that raw material heavy oil. The following simple test can be applicable to find out a surface-active agent having good affinity and compatibility with a particular raw material heavy oil. First, the raw material heavy oil is placed in test tubes, as is, when it is liquid at ambient temperature, or after dilution with benzene or xylene to form a solution, when it is solid at ambient temperature. Then, aqueous solutions of various surface-active agent are added and the mixtures are ultrasonically and mechanically vibrated to observe the degrees of dispersion. The results are grouped into 1) surface-active agents which cannot disperse the raw material heavy oil at all, 2) surface-active agent which can disperse the raw material heavy oil to a certain degree, but with some amount of raw material heavy oil adhered to the wall of the test tube, and 3) surface-active agent which can produce a complete homogeneous dispersion. The surface-active agent which is suitable for emulsifying the raw material heavy oil can be easily selected by means of this simple method. Usually, the surface-active agent is selected from the group 3), that is, from the 20 surface-active agent capable of completely homogeneously dispersing the raw material heavy oil.

The amount of the surface-active agent used varies depending on the kind and viscosity of the raw material heavy oil and the type of the emulsification equipment used. Usually, this amount is selected from the range of 0.5–30% by weight, preferably 1–20% by weight, of the raw material heavy oil.

When the emulsification treatment is carried out, it is possible to add a small amount of an emulsion stabilizer or a protective colloid of water-soluble polymer or the like to adjust the viscosity.

The amount of water used for the emulsification treatment is varied depending on the type of the emulsification equipment and, usually, this amount is selected from the range of 0.5–10 parts by weight, preferably 1–5 parts by weight, for one part by weight of the raw material heavy oil. If the amount of water is too small, a water-in-oil (W/O) type in which fine droplets of water are dispersed in a continuous phase of the raw material heavy oil will result, failing to produce fine spherical particles of oil. It is necessary for the present invention to produce an oil-in-water (O/W) type emulsion in which fine spherical particles of the raw material heavy oil with a particle size of 100 μm or less are dispersed in water. To this end, the W/O type emulsion must be converted into the O/W type by adding water containing a surface-active agent to liquid raw material heavy oil with an appropriate viscosity while the latter is stirred in an autoclave or the like. The quantity of the water to be added to convert the W/O type emulsion to the O/W type should be the minimum amount of water required for the emulsification. The amount of water as small as possible is preferable in view of the separation, recovery, or removal of the solvent, light components, and water from the liquid layer obtained in the subsequent third step. However, because the emulsion immediately after the conversion from the W/O type to O/W type has a high apparent viscosity, it is desirable to add a quantity of water in excess of that required to the emulsion conversion taking into consideration to the ease of transfer of the emulsion liquid, the ease of extraction operation to remove light components with an organic solvent from fine spherical particles of the raw material heavy oil in the subsequent second step, and the like. Usually, the concentration of the raw material heavy oil in the resulting emulsion is adjusted to 10–60% by weight, and preferably 20–50% by weight.

Also, it is necessary to make the fine spherical particles of the raw material heavy oil with a particle size of 100 μm or less, preferably 50 μm or less, and more preferably 20 μm or less, in the emulsification treatment. If the particle size is larger than 100 μm, it takes a long time to remove light components from the fine spherical particles using an extracting organic solvent in the subsequent second step, because it is necessary to extract the light components from the inside of the particles. As a result, the time required for producing sufficiently high softening point pitch is lengthened and the size of the equipment must be unduly enlarged. In addition, such large size particles may be easily precipitated when the emulsion is allowed to stand or when there is a stream which flows slowly in the equipment. The precipitated particles may choke up the equipment.

The second step of the present invention comprises causing the emulsion obtained in the first step to come in contact with an extracting organic solvent which can dissolve water and capable of leaving at least 10% by weight of the raw material heavy oil as an insoluble portion to remove light components from the fine spherical particles of the raw material heavy oil in the emulsion and also the diluting organic solvent, when the raw material heavy oil was adjusted by dilution or dissolution using the diluting organic solvent in the first step, thereby obtaining fine particles of pitch with a high softening point. The extracting organic solvent used in the second step must form a homogeneous liquid layer by dissolving the water in the emulsion in which the fine spherical particles of the raw material heavy oil are dispersed. Thus, the extracting organic solvent used should be those which can dissolve the water in the emulsion and can produce a liquid phase of extracting organic solvent containing water and a solid phase of the fine particles of pitch with a high softening point from which light components have been removed by extraction. Included in specific examples of such extracting organic solvents are ketones, such as methyl ethyl ketone (MEK) and acetone; alcohols, such as methanol, ethanol, n-propanol, iso-propanol IPA), n-butanol and sec-butanol (SBA); and the like.

The solubility of water in typical organic solvents used in the second step is shown in Table 2. As indicated in Table 2, the solubility of water varies depending on the kind of solvent. When an organic solvent with a limited solubility of water, such as MEK, n-butanol, and SBA, is used and the amount of water present in the system is in excess of the quantity which the organic solvent can dissolve, not only it is difficult to sufficiently extract and remove light components from the fine spherical particles of the raw material heavy oil, but also the excess water which cannot be dissolved in the organic solvent is separated out. The consequence will be formation of three layers; i.e. the organic solvent layer, the layer of the water thus separated out, and a muddy or doughy layer with scum of the fine particles of the raw material heavy oil.

When such three layers are existed, difficulties will be encountered in the succeeding third step to separate and recover fine particles of pitch with a high softening point produced from the raw material heavy oil. For example, when filtration is employed for the separation, the filter may be choked up and such choke-up makes it difficult to separate and recover the fine particles.

TABLE 2

| Solvent | Solubility of water in the solvent[1] (vol. %) |
|---|---|
| MEK | 9.9 |
| Acetone | arbitrarily soluble[2] |
| Methanol | arbitrarily soluble |
| Ethanol | arbitrarily soluble |
| n-propanol | arbitrarily soluble |
| IPA | arbitrarily soluble |
| n-butanol | 20.6 |
| SBA | 36.5 |

[1]: Maximum amount of water soluble in the solvent.
[2]: "Arbitrarily soluble" means that the solvent can dissolve any amount of water without limitation.

Therefore, when an extracting organic solvent with limited solubility of water is used, the ratio of this organic solvent to water should be selected from the range which enables the solvent to dissolve all the water present in the system.

Furthermore, when the extracting organic solvent used completely dissolves all the raw material heavy oil, no pitch with an increased softening point can be obtained. The organic solvent therefore must leave at least 10% by weight of the raw material heavy oil as an insoluble portion, which will be the pitch with a high softening point. The dissolution ability of the extracting organic solvent to raw material heavy oil is related to a solubility parameter (Solvent Pocketbook, The Society of Synthetic Organic Chemistry, Japan; Adhesion Chemistry and Practice, Kobunsha Kankokai). The closer the solubility parameter of this extracting organic solvent to the solubility parameter of benzene (9.1), toluene (8.9), or xylenes (8.8) which is the good solvent optionally used for conditioning the raw material heavy oil in the first step, the greater the amount of the light components removed by extraction from the raw material heavy oil, therefore the smaller the recovery yield of the pitch, but higher the softening point of the resulting pitch. Therefore, it is possible to adjust the solubility parameter by blending two or more organic solvents with a different solubility parameter according to the target softening point of the pitch.

The solubility parameter of typical organic solvents used in the second step is as follows: MEK=9.3, acetone=9.8, methanol=14.8, ethanol=12.8, n-propanol=12.1, IPA=11.2, n-butanol=11.1, SBA=11.0.

If necessary, these organic solvents may be mixed with water and used as a solution of the solvent and water. Specifically, because the solubility parameter of water is 23.4, the mixture of water and the organic solvent has a higher solubility parameter than the solvent alone. The mixture therefore exhibits decreased dissolution ability to raw material heavy oils, affords a higher recovery yield of pitch, and produces pitch with a lowered softening point. Accordingly, in the same manner as the use of two or more organic solvents with different solubility parameter, the solubility parameter may be adjusted by adding water to the organic solvent according to the target softening point of the resulting pitch.

In addition, the use of the above-described organic solvent can effectively remove the diluting organic solvent used for conditioning the raw material heavy oil by extraction together with the light components in the raw material heavy oil, in the case where such diluting organic solvent was used for diluting or dissolving the raw material heavy oil in the first step and the raw material heavy oil is dispersed in that extracting organic solvent as fine spherical particles.

The extraction-removal operation of light components in the raw material heavy oil in the second step can be carried out by contacting the extracting organic solvents which satisfy these requirements mentioned above and the emulsion of the raw material heavy oil obtained in the first step. Because the fine spherical particles of the raw material heavy oil obtained in the first step have a particle size of micron order, the extraction rapidly occurs. The extraction can be carried out within a very short time without requiring a high temperature. The use of a simple stirring facility is sufficient and the extraction will be usually completed within one hour while stirring under conditions near the ambient temperature and normal pressure.

Any method can be used to cause the emulsion to come in contact with the extracting organic solvent. For example, either (A) the method of adding the emulsion to the extracting organic solvent or (B) the method of adding the extracting organic solvent to the emulsion is applicable. However, in the case where the raw material heavy oil is a liquid with a viscosity of 1,000 poise or less at ambient temperatures or the raw material heavy oil has been conditioned using a diluting organic solvent by the method (b) or (c), the method of adding the emulsion to the extracting organic solvent (A) should be used. If the method of adding the extracting organic solvent to the emulsion (B) is used, the fine spherical particles of the raw material heavy oil agglomerate beginning from the portion which first comes in contact with the organic solvent and may produce a large lump of viscous greasy material. However, in the case where the raw material heavy oil is a viscous liquid with a viscosity higher than 1,000 poise or a solid pitch at ambient temperatures, and has been conditioned by the method of heating (a), the method of adding the extracting organic solvent to the emulsion (B) does not cause the fine spherical particles of the raw material heavy oil to agglomerate and to produce a large lump of viscous greasy material. Another method of contact (method (C)) is to prepare a mixture from a small amount of emulsion and a small amount of extracting organic solvent by the method (A) or (B), and then to add the emulsion and the organic solvent at a prescribed proportion simultaneously to the mixture. The method (C) is preferably used in the case where particularly high homogeneity in the softening point of the resulting fine particles of pitch and a continuous operation of the treatment are pursued, taking into account the problems in the methods (A) and (B), such as the variation in the solubility parameter of the organic solvent in the liquid mixture and the resulting fluctuation in the degree of softening point increase in the fine spherical particles of the raw material heavy oil. Specifically, in the method (A) although the solubility parameter of the organic solvent in the liquid mixture is low at the beginning of emulsion addition due to a high concentration of organic solvent in the liquid mixture, the solubility parameter increases as the added amount of emulsion containing water increases, resulting in decrease in the capability to extract and remove the light components from the fine spherical particles of the raw material heavy oil. The opposite phenomenon occurs in the method (B). In either case, there is some fluctuation in the degree of the softening point increase in the fine spherical particles of the raw material heavy oils at the beginning and the end of the addition of either the emulsion or the organic solvent. In this method (C), when the raw material heavy oil is a liquid with a viscosity of 1,000 poise or less at ambient temperatures or when the viscosity of the raw material heavy oil is adjusted using a diluting organic solvent by the method (b) or (c), it is desirable to use the method (A) for preparing the mixture from small amounts of emulsion and extracting organic solvent.

A known facility, such as a common mixing vessel equipped with a stirrer, can be used for the extraction-removal treatment of the second step without no specific limitations. In addition, either a batch or continuous facility can be used.

The third step of the present invention is a step for separating and recovering fine particles of pitch with a high softening point from the liquid mixture produced by the contact of the emulsion and the extracting organic solvent in the second step. According to the present invention, fine particles of pitch with an increased high softening point in the liquid mixture obtained in the second step easily precipitate. The difference between the specific gravities of the liquid phase and the solid pitch in the mixture is a readily understandable reason for the precipitation. The fine particles of pitch go down and precipitate at a higher speed due to the difference in the specific gravities. Another potential reason is the decrease in the dispersibility of the extracting organic solvent used in the second step due to dissolution and removal of the surface-active agent used in the first step from the surface of the fine particles contained in the emulsion. The decrease in the dispersibility of the organic solvent may cause the fine particles to agglomerate and to precipitate at a faster rate. Even if agglomerated, no fusion or adhesion will occur between the fine particles of pitch, because the softening point of such fine particles of pitch has already been increased in the present invention. In this manner, fine particles of pitch with an increased high softening point in the liquid mixture obtained in the second step can be easily separated and recovered by means of the present invention.

Any conventional methods of solid-liquid separation, such as decantation, filtration, and centrifuge, can be used for the separation and recovery.

The fine particles of pitch with an increased softening point which have been recovered may be washed as required. The extracting organic solvent used in the second step or a mixture of this organic solvent and water is usually used for the washing. In the case where the recovered fine particles of pitch recovered contain a large amount of the extracting organic solvent which contains the light components extracted from the raw material heavy oil in the second step in the spaces between the particles, such as the case where decantation is employed for the recovery of the fine particles of pitch with a high softening point, it is desirable to use a washing solvent with a solubility equivalent to or slightly larger than the solubility of the mixture of water and the organic solvent which existed in the liquid phase of the emulsion in the second step. If the washing solvent has a solubility extremely smaller than the mixture existed in the liquid phase of the emulsion in the second step, the light components may be released from the organic solvent which is present in the spaces between the recovered fine particles of pitch. Such light components released may cause adverse effects. They may be absorbed by or attached to the surface of the fine particles and cause these fine particles to get together, or decrease the softening point of pitch once raised by means of the present invention.

The fine particles of pitch with an increased softening point optionally washed are usually dried to produce the target fine particles of pitch with a high softening point. There are no limitations to the method of drying. If heated to a high temperature while the organic solvent still remains, a portion of the fine particles of pitch may be melted or fused together before the organic solvent evaporates due to increase in the solubility of the organic solvent to the fine particles of pitch. It is therefore desirable to remove the organic solvent at a comparatively low temperature under vacuum when an organic solvent with a comparatively high boiling point is used or a large amount of the solvent remains. The organic solvent with a low boiling point, even if remains in a slight amount, will not cause the fine particles of pitch to melt or be fused together, because the solvent will evaporate faster than it causes the fine particles of pitch to melt or be fused together.

The softening point of the target fine particles of pitch thus obtained is significantly varied depending on the kind of the raw material heavy oils, the particle size of the fine spherical particles produced in the first step, the kind of organic solvent used in the second step, the ratio of the organic solvent and water, and the like. If the application of the fine particles of pitch is taken into consideration, the softening point should be at least 100° C., and preferably at least 1501° C. Especially, in the case where the manufacture of carbon fine particles is intended by further rendering infusible and carbonizing the fine particles of the pitch, the softening point of 200° C. or higher is particularly preferred.

The fine particles of pitch with a high softening point obtained have the almost same spherical shape as the emulsion particles of the raw material heavy oil in the first step, when this raw material heavy oil is solid at ambient temperatures and the aforementioned method of heating (a) was employed for conditioning the raw material heavy oil to become a liquid having a viscosity of 1,000 poise or less.

On the other hand, when the raw material heavy oil is a liquid with a viscosity of 1,000 poise or less and needs not be conditioned for the emulsification treatment in the first step, or when the raw material heavy oil is a viscous liquid with a viscosity above 1,000 poise or is solid at ambient temperatures and the aformentioned method (b) or (c) of using an organic solvent to dilute or dissolve the raw material heavy oil is employed for conditioning to afford a viscosity of 1,000 poise or less suitable for the emulsification treatment, the same spherical shape of the fine particles in the emulsification treatment of the first step does not always kept in the second step.

The size of the fine particles of pitch with a high softening point produced by the process of the present invention cannot be generically defined, because the size varies depending on various conditions for carrying out the process of the present invention, such as the kind of the raw material heavy oil used; the conditioning means used for adjusting the viscosity of the raw material heavy oil suitable for the emulsification treatment in the first step, i.e. whether or not the method (b) or (c) using an organic solvent has been used; the conditions for the emulsification treatment in the first step; the kind of organic solvent used in the second step (the solubility parameter); and the like. Such a size is generally 200 μm or less. The fine particles of pitch with a high softening point of any optional size within this range can be obtained by appropriately selecting these various conditions in performing the process of the present invention.

The fine particles of pitch with a high softening point can be used as a carbon material for various applications, a material for C/C composites, and a binder for refractory bricks and the like. The particles with a sufficiently high softening point can be easily rendered infusible by the wet oxidation method using nitric acid, sulfuric acid, or hydrogen peroxide, or by the dry oxidation method using air, oxygen, ozone, nitrogen oxide, or iodine. The infusible material can be easily carbonized or graphitized into fine particles of carbon or graphite, and used as carbon fillers, fillers for composite materials, materials for conductive resin, dispersion particles for electro rheological fluids, the cathod material for lithium ion secondary battery, the fillers and adsorbents for HPLC, and the like.

According to the present invention, pitch fine particles having a higher softening point can be prepared readily, efficiently and economically from heavy oils which are liquid at normal temperature, or pitches which are solid at normal temperature, preferably pitches having a softening point of 150° C. or less, without any difficulties mentioned before relative to conventional processes for manufacturing pitch fine particles. According to the process of the present invention, clear spherical pitch fine particles can be obtained by the selection of suitable preparation conditions. Further, by the process of the present invention, the softening points and/or the sizes of pitch fine particles having a high softening point can easily be controlled to desired levels by the selection of suitable preparation conditions.

Among the pitch fine particles having a high softening point, pitch fine particles having higher softening point, e.g. higher than 200° C., can easily be rendered infusible, and carbon or graphite fine particles can be obtained by rendering infusible, carbonizing, and graphitizing such pitch fine particles.

DESCRIPTION OF THE PREFERRED EMBODIMENTS

The present invention will be illustrated in more detail by examples which are not intended to be limiting thereof.

EXAMPLE 1

A pitch was prepared by a vacuum distillation of a naphtha cracking tar which had an elemental analysis of C: 92.3 wt. %, H: 7.7 wt. % and S: 0.02 wt. %. The pitch thus obtained had following properties: Softening point by a temperature gradient method: 71° C., xylene insolubles: 0% by weight, weight loss by heating up to 300° C.: 17.9% by weight.

Elemental analysis: C: 92.9 wt %, H: 7.0 wt. %, S: 0.02 wt %

Yield of the pitch based on the naphtha cracking tar was 48%. The pitch was treated by the followings steps.

The first step

Into a 1 liter glass autoclave equipped with an agitator having anchor-like agitating blades, 100 g of the pitch and 10 g of polyoxyethylene nonylphenyl ether (Kao Company, Emulgen 985; tradename) as a nonionic surface-active agent were charged and the autoclave was sealed in the air atmosphere under normal pressure and then the pitch was melted at 130° C. by heating. The pitch showed a viscosity of 363 poise at the temperature.

Then, the content was agitated by the agitator at a constant rotation rate of 1,000 rpm at a temperature of 130° C. A pressurized hot water was gradually added to the autoclave while maintaining the agitation at the rate keeping the temperature of 130° C. Sufficient electric current was applied so as to keep the agitation at the constant rate. The ampere of electric current was gradually increased parallel to the addition of water. While continuing the addition of water, it was found that the ampere of electric current dropped suddenly at the time when 50 ml of water was added. At the same time, the color of the liquid turned yellowish indicating that the phase was changed from water-in-pitch (W/O) state to pitch-in-water (O/W) state. At that time, the autoclave was still maintained at the temperature of 130° C. and the pressure of the autoclave was 2.5 $Kg/cm^2$.G.

After the conversion of phase from W/O to O/W was confirmed, rotation rate of the agitator was immediately dropped to 500 rpm, and 200 ml of cold water was pumped into the autoclave. Thus, the temperature of the content of the autoclave was dropped to 105° C.

Then, the autoclave was cooled to room temperature by immersing the bottom of the autoclave in cold water. When the content of the autoclave was taken out, a yellowish emulsified liquid was obtained. The liquid was settled for several hours and even after the settlement, no precipitation of the pitch was recognized. A small amount of the emulsion was air-dryed at room temperature and examined by a scanning electron microscope and found that the sample was clear fine spherical particles of pitch having maximum diameter of about 10 μm.

Further, a small amount of the emulsion was put into a glass Petri dish and dried at 110° C. in a dryer. The fine spherical particles of pitch contained in the emulsion were melted together and no fine spherical particles of pitch was remained.

The second step

As extracting solvents, methylethylketone (MEK), acetone, n-butanol, sec-butanol (SBA), iso-propanol (IPA), ethanol, and methanol were used. Into respective beakers, 100 ml of solvents mentioned above were charged, respectively. While stirring with a magnetic stirrer, 10 ml of the emulsion prepared above was added, respectively and the stirring was continued for further 10 minutes. When the stirring was stopped and the beakers were kept to stand, pitch particles were easily settled. It was found that the pitch particles were coagulated each other and the supernatant liquid was clear but slightly colored yellowish or orange indicating the extraction of lighter components contained in the pitch particles into the supernatant liquid being occurred.

The third step and washing and drying treatments

Then, content of the beaker was filtered through 5 μm appature glass filter medium with suction. The filtration was smoothly conducted without pass-through of pitch particles. Thus, the pitch particles were easily recovered. The pitch particles separated on the filter were washed several times by the use of total 100 ml of the solvent used in the second step. The pitch particles thus obtained were dried at 30° C. under a vacuum of 10 mmHg to remove solvent. The dried pitch particles thus obtained were further dried in a dryer kept at 110° C. Desired fine particles of pitch with a high softening point:

Relative to the pitch particles thus obtained, appearance after drying in the dryer, softening point of pitch fine particles, weight loss by heating up to 300° C. and yield of pitch fine particles based on the raw material pitch were as shown in Table 3. Notwithstanding any solvents were used, yellowish pitch particles with higher softening point than the raw material pitch used were obtained.

TABLE 3-1

| | Experiment | | | |
|---|---|---|---|---|
| Solvent | 1 Before treatment | 2 MEK | 3 Acetone | 4 n-Butanol |
| Solubility parameter of the solvent | — | 9.3 | 9.8 | 11.1 |
| Softening point (°C.) | 71 | 240 | 258 | 225 |
| Weight loss by heating (wt. %) | 17.9 | 1.6 | 1.8 | 1.5 |
| Appearance after drying at 110° C. | Melted | Not melted | Not melted | Not melted |
| Yield (%) | — | 20 | 34 | 56 |

TABLE 3-2

| | Experiment | | | |
|---|---|---|---|---|
| Solvent | 5 SBA | 6 IPA | 7 Ethanol | 8 Methanol |
| Solubility parameter of the solvent | 11.0 | 11.2 | 12.8 | 14.8 |
| Softening point (°C.) | 216 | 185 | 202 | 134 |
| Weight loss by heating (wt. %) | 1.8 | 3.0 | 3.1 | 8.1 |
| Appearance after drying at 110° C. | Not melted | Not melted | Not melted | Partly melted[1)] |
| Yield (%) | 63 | 75 | 74 | 89 |

1): Partly melted and fused each other. Not melted by drying at 80° C. Spherical particles had maximum diameter of about 10 μm which was essentially the same maximum diameter of the particles contained in the emulsion.

Elemental analysis of fine pitch particles obtained in Experiment 5: C: 92.8 wt %, H: 7.1 wt. %, S: 0.03 wt. %

The dried pitch particles were examined by a scanning electron microscope and following results were found: With the exception of methanol (Experiment 8), notwithstanding any solvents were used, no fusion of particles was occurred and spherical particles having maximum diameter of about 10 μm which is essentially the same maximum diameter of the particles contained in the emulsion were obtained. When methanol was used as a solvent (Experiment 8), some parts of particles were fused together. When MEK was used as a solvent (Experiment 2), particles having large hole and non-spherical particles were found in a high rate. When acetone was used (Experiment 3), though the particles were spherical, the particles have many micropores on the surface thereof. FIG. 1 is a scanning electron microscopic photograph of fine spherical particles of high softening point pitch obtained by the use of SBA (Experiment 5) as extracting solvent.

Incidentally, from the three elemental analyses mentioned above, it can be understood that though the process of the present invention includes multiple process steps, e.g. emulsifying step, extracting step, filtering step, and washing step, H/C ratio is almost not affected by these process steps because the aimed product has essentially the same H/C ratio as that of the starting material. Accordingly, it can be concluded that the yellowish fine spherical particles obtained above are fine particles of pitch with a high softening point.

EXAMPLE 2

An experiment was conducted in the exactly the same manner as in Example 1 using the same pitch as used in Example 1, except that the extracting solvent used in the second step was changed to a mixed solvent of acetone and water having the composition shown in Table 4. Thus, yellowish pitch fine particles were obtained.

Softening point, weight loss by heating up to 300° C., appearance after heating at 110° C. and yield based on the raw material pitch of the objective pitch fine particles were as shown in Table 4.

The objective pitch fine particles after drying were inspected by a scanning electron microscope and found that the pitch fine particles prepared by using mixed solvents having the compositions of acetone/water of 90/10 and 80/20 were clear spherical particles and no micropores which were observed in the spherical particles obtained by the use of acetone alone as the extracting solvent (Experiment 3) in Example 1 were not observed.

TABLE 4

| | Experiment | |
|---|---|---|
| | 9 | 10 |
| Mixed ratio (% by volume) acetone/water | 90/10 | 80/20 |
| Softening point (°C.) | 216 | 184 |
| Weight loss by heating (wt. %) | 2.3 | 5.4 |
| Appearance after drying at 110° C. | Not melted | Not melted |
| Yield (%) | 63 | 68 |

EXAMPLE 3

The first step was conducted as follows: Into an autoclave used in Example 1, 100 g of pitch used in Example 1 and 15 g of a nonionic surface-active agent (Emulgen 985) were charged. The autoclave was sealed in an air atmosphere under normal pressure and the pitch was melted at 122° C. by heating. The pitch had a viscosity of 752 poise at the temperature.

Then, at 122° C., the molten pitch was emulsified as in Example 1 by adding water, provided that the water used in this example contained 0.1% by weight of sodium salt of carboxymethylcellulose (Cerogen 5A; tradename, Daiichi Kogyo Seiyaku K.K.) as a dispersion-stabilizing agent.

When the emulsion thus obtained was examined by an optical microscope, production of clear fine spherical particles of pitch having miximum diameter of about 50 μm was observed.

Then, the second step and the successive step and treatments were conducted as follows: As an extracting solvent, 300 ml of n-butanol was used. Into the n-butanol stirred by a magnetic stirrer at room temperature, 30 ml of the emulsion was charged and the mixture was further stirred for 10 minutes. The mixture was filtered, washed, and dried as in Example 1. Thus, ochre pitch fine particles were obtained as the aimed product.

The pitch fine particles thus obtained had a softening point of 167° C. and a weight loss by heating up to 300° C. of 7.5% by weight. The yield of the pitch fine particles based on the raw material pitch was 79% by weight. When the fine particles were examined by a scanning electron microscope, it was found that the fine particles were spherical particles having a diameter of almost the same diameter of fine particles contained in the emulsion.

EXAMPLE 4

This example shows a result obtained by using a pitch having a lower softening point than the pitch used in Example 1. A pitch having following properties was obtained by vacuum distillation of the naphtha cracking tar used in Example 1. Softening point by temperature gradient method: 64° C., xylene insolubles: 0% by weight, weight loss by heating at 300° C.: 21.2% by weight The first step was conducted by using the pitch mentioned above as follows: Into a 1 liter glass autoclave, 100 g of the pitch and 20 g of a nonionic surface-active agent (Emulgen 985) were charged and the autoclave was sealed in the air atmosphere under normal pressure. The pitch was melted by heating the autoclave up to 120° C. The viscosity of the pitch at 120° C. was 167 poise.

Then, the content of the autoclave was emulsified at 120° C. by the addition of water in the same manner as in Example 1. A small amount of the emulsion thus obtained was air-dried at room temperature. The dried product was examined by a scanning electron microscope and found that the dried product was clear spherical fine particles of pitch having maximum diameter of about 10 μm.

Then, the second step and the successive step and treatments were conducted as follows: Extraction was conducted by using 100 ml of acetone and filtration, washing, and drying operations were carried in the same manner as in Example 1. Thus, yellowish fine particles of pitch were obtained as the aimed products. The pitch fine particles thus obtained had a softening point of 242° C., and a weight loss by heating up to 300° C. of 1.7% by weight. The yield based on the raw material pitch was 33% by weight. When the fine particles were examined by a scanning electron microscope, it was found that the fine particles were spherical and had diameter of almost the same diameter of particles contained in the emulsion.

EXAMPLE 5

This example shows a result obtained by using a pitch having higher softening point than the pitch used in Example 1. A pitch having following properties was obtained by a vacuum distillation of the naphtha cracking tar used in Example 1. Softening point measured by temperature gradient method: 78° C., xylene insolubles: 0% by weight, weight loss by heating up to 300° C.: 16.7% by weight By using the pitch mentioned above, the first step was conducted as follows: Into a 1 liter glass autoclave, 100 g of the pitch and 20 g of a nonionic surface-active agent (Emulgen 985) were charged and sealed in an air atmosphere under normal pressure. The pitch was melted by heating up to 133° C. The viscosity of the pitch at 133° C. was 355 poise. Then the content of the autoclave was emulsified by the addition of water in the same manner as in Example 1. A small amount of the emulsion thus obtained was air-dried at room temperature. The dried product was examined by a scanning electron microscope and found that the product was clear spherical pitch fine particles having maximum diameter of about 10 μm. Then, the second step and the successive step and treatments were conducted as follows:

By using 100 ml of acetone was used as the extracting solvent, extraction, filtration, washing, and drying were carried out in the same manner as in Example 1. Thus, yellowish pitch fine particles were obtained as the aimed product. The aimed product having a softening point of 252° C. and a weight loss by heating up to 300° C. of 2.1% by weight was obtained. The yield based on the raw material pitch was 38% by weight. When the fine particles were examined by a scanning electron microscope, it was found that the particles were fine spherical particles having almost the same diameter as that of micro particles contained in the emulsion.

EXAMPLE 6

A pitch solution was prepared by dissolving 70 g of the pitch used in Example 1 in 30 g of xylene. The viscosity of the solution at 25° C. was 9.75 poise.

By using the pitch solution, the first step was conducted as follows: Into the pitch solution, 150 ml of water containing 2% by weight of a nonionic surface-active agent (Emulgen 985) was added. The mixture was agitated and mixed at room temperature for 5 minutes by using a propeller-type mixer rotating at a rate of 500 rpm while concurrently giving ultrasonic vibrations. By the treatment, the mixture was turned ochre and a homogeneous emulsion was formed. When the emulsion was observed by an optical microscope, it was found that in the emulsion, pitch fine spherical particles having maximum diameter of about 50 μm were uniformly dispersed.

Then, the second step and the successive step and treatments were conducted as follows: Into 100 ml of methylethylketone as an extracting solvent stirred with a magnetic stirrer, 5 ml of the emulsion prepared above was added at room temperature and the mixture was further stirred for 5 minutes. The mixture was filtered, washed, and air-dried in the same manner as in Example 1, thereby obtained ochre pitch fine particles as the aimed product. The pitch fine particles had softening point of 268° C. The yield based on the raw material pitch was 16% by weight. When the fine particles were examined by a scanning electron microscope, it was found that the fine particles were a mixture of different shapes having maximum diameter of less than 100 μm.

EXAMPLE 7

A pitch solution was prepared by dissolving 60 g of the pitch used in Example 1 in 40 g of benzene. The viscosity of the pitch solution at 25° C. was 0.64 poise.

By using the pitch solution, the first step was conducted as follows: Into the pitch solution agitated with a homogenizer (POLYTORON PT45-80; tradename, Kinematica Co., Ltd.) rotated at a rate of 5,000 rpm at room temperature, 200 ml of water containing 2% by weight of a nonionic surface-active agent (Emulgen 985) was added and the mixture was further agitated. Thereby an yellowish emulsion was formed. The emulsion was observed by an optical microscope and found that in the emulsion, pitch fine spherical particles having maximum diameter of about 10 μm were uniformly dispersed.

Then, the second step and the successive step and treatments were conducted as follows: Experiments were carried out by using acetone, n-butanol, or ethanol in respective experiment. While stirring at room temperature by a magnetic stirrer, 10 ml of the emulsion prepared above was charged into 100 ml of the solvent, respectively, and stirring was further continued for 10 minutes.

In each experiment, yellowish pitch fine particles were obtained as the aimed product by conducting filtration, washing, and drying in the same manner as in Example 1.

The softening point, weight loss by heating up to 300° C. and yield based on the raw material pitch, of the aimed product, i.e., yellowish pitch fine particles are shown in Table 5.

TABLE 5

| | Experiment | | | |
|---|---|---|---|---|
| Solvent | 11 Before treatment | 12 Acetone | 13 n-Butanol | 14 Ethanol |
| Solubility parameter of the solvent | — | 9.8 | 11.1 | 12.8 |
| Softening point (°C.) | 71 | 247 | 199 | 118 |
| Weight loss by heating (wt. %) | 17.9 | 2.1 | 2.1 | 10.1 |
| Yield (%) | — | 35 | 59 | 84 |

EXAMPLE 8

Experiments were conducted in which the first step, the second step, and the third step were carried out in the same manner as in Example 7 except that the extracting solvent used in the second step were changed to mixed solvents of acetone and water as shown in Table 6 and the successive washing and drying treatments were conducted in the same manner as in Example 1.

Thus, yellowish pitch fine particles were obtained as the aimed products. The softening point, weight loss by heating up to 300° C., and yield based on the raw material pitch of the aimed products, i.e., yellowish pitch fine particles were shown in Table 6. When the pitch fine particles thus obtained were examined by a scanning electron microscope, it was found that the pitch fine particles obtained by the use of mixed solvent having acetone/water weight ratio of either 90/10 or 80/20 were clearly spherical and the diameters of the pitch fine particles were increased with the inclement of the water contents.

TABLE 6

| | Experiment | |
|---|---|---|
| | 15 | 16 |
| Mixed ratio (% by volume) acetone/water | 90/10 | 80/20 |
| Softening point (°C.) | 192 | 170 |
| Weight loss by heating (wt. %) | 5.0 | 7.1 |
| Yield (%) | 73 | 77 |

EXAMPLE 9

A pitch solution was prepared by dissolving 60 g of the pitch used in Example 1 in 40 g of benzene. The first step was conducted by using the pitch solution as follows: While the pitch solution was stirring at room temperature at a rotating rate of 5,000 rpm by the use of the homogenizer used in Example 7, 116 ml of water containing 8% by weight of a nonionic surface-active agent (Emulgen 985) was added thereto and stirring was continued further, thereby obtained an yellowish emulsion. When the emulsion was observed by an optical microscope, it was found that in the emulsion, spherical pitch fine particles having maximum diameter of about 10 μm were uniformly dispersed.

Then, the second step and the successive step and treatments were carried out as follows: While stirring 100 ml of n-butanol as the extracting solvent by a magnetic stirrer at room temperature, 10 ml of the emulsion prepared above was added thereto and stirring was continued for further 10 minutes. The mixture was filtered, washed, and dried in the same manner as in Example 1. Thus, yellowish pitch fine particles were obtained as the aimed product.

Figure 2:
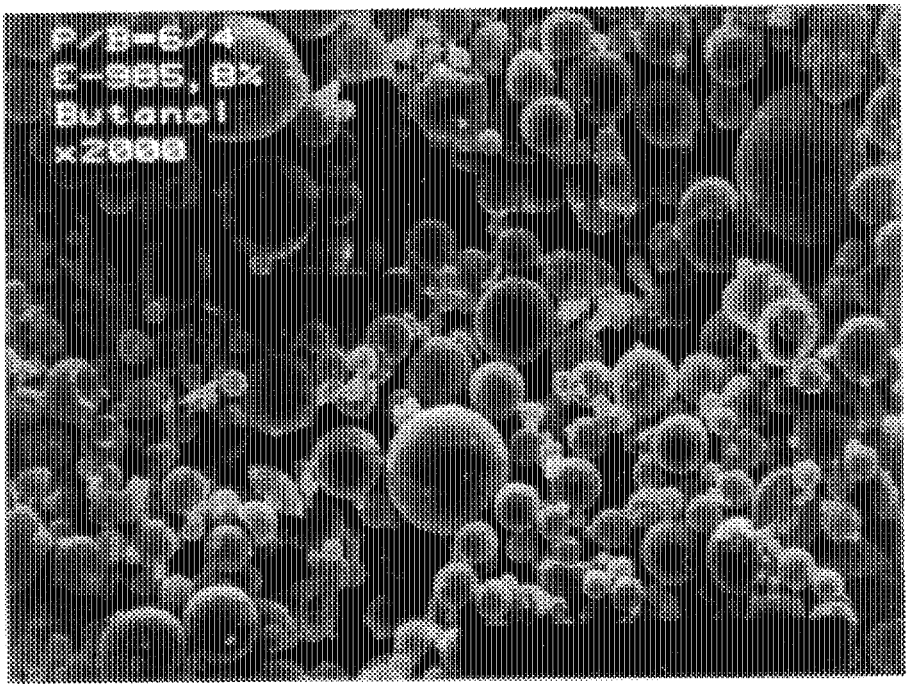
FIG. 2 is a scanning electron microscopic photograph of the fine spherical particles of pitch with a high softening point obtained in Example 9. The length of the segment shown below the photograph corresponds to 10 μm.

The aimed product, i.e., the pitch fine particles thus obtained had a softening point of 214° C., and a weight loss by heating up to 300° C. of 2.6% by weight. The yield of the pitch fine particles based on the raw material pitch was 65% by weight. When the pitch fine particles were examined by a scanning electron microscope, it was found that though a portion of the fine particles had distorted shape, major part of the fine particles had spherical shape similar to the particles contained in the emulsion. FIG. 2 is a scanning electron microscopic photograph of the fine spherical particles of the high softening point pitch obtained in this example.

EXAMPLE 10

The first step was conducted by using naphtha cracking tar used in Example 1 as follows: Into a glass flask, 100 g of the naphtha cracking tar was charged. The naphtha cracking tar was emulsified by gradually adding 120 ml of water containing 4% by weight of a nonionic surface-active agent (Emulgen 985) to the naphtha cracking tar while stirring the tar by the homogenizer used in Example 7 rotating at a rate of 5,000 rpm at room temperature. Incidentally, the naphtha cracking tar had a weight loss by heating up to 300° C. of 59.5% by weight, and a viscosity at 25° C. of 1.3 poise.

Then, the second step and the successive step and treatments were carried out as follows: As an extracting solvent, 100 ml of n-butanol was used. While the solvents was stirred at room temperature by a magnetic stirrer, 10 ml of the emulsion prepared above was added into the solvent and the mixture was stirred for further 10 minutes.

The mixture was filtered, washed, and dried in the same manner as in Example 1, thereby obtained yellowish pitch fine particles as the aimed product.

The aimed product, i.e., pitch fine particles had a softening point of 210° C., and a weight loss by heating up to 300° C. of 4.5% by weight. The yield of the pitch fine particles based on the raw material naphtha cracking tar was 32% by weight. When the fine particles were examined by a scanning electron microscope, it was found that the particles were fine spherical particles having maximum diameter of about 10 μm.

EXAMPLE 11

By using a naphtha cracking tar having higher softening point than that used in Example 1, the first step was conducted as follows: Into a glass flask, 100 g of the naphtha cracking tar was charged, and the glass flask was heated by immersing it in a hot water kept at 60° C. The tar was emulsified by gradually adding 100 ml of water containing 5% by weight of a nonionic surface-active agent (Emulgen 985) maintained at 60° C. into the tar. When the hot water was added to the tar, the tar was maintained at a stirred condition by the use of the homogenizer used in Example 7 rotating at a rate of 5,000 rpm. After the addition of hot water, the mixture was cooled to room temperature. Incidentally, the naphtha cracking tar used had a weight loss by heating up to 300° C. of 42.3% by weight, and a viscosity at 60° C. of 7.5 poise.

Figure 3:
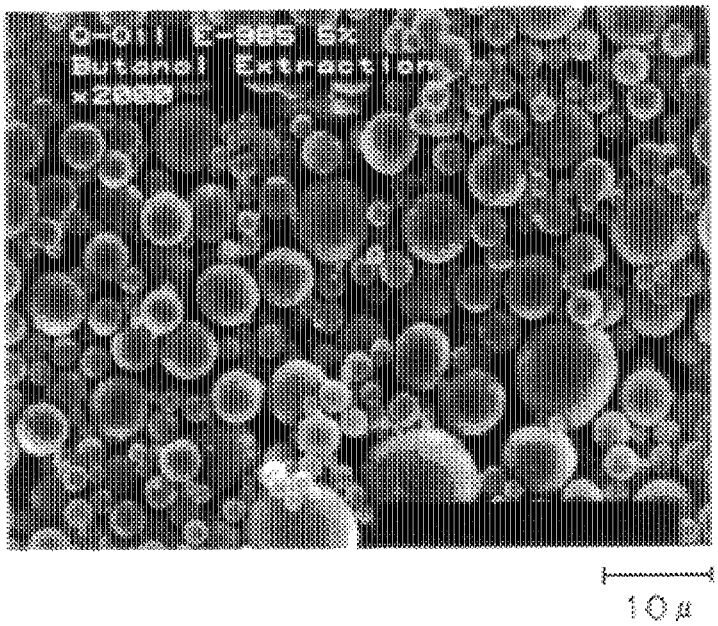
FIG. 3 is a scanning electron microscopic photograph of the fine spherical particles of pitch with a high softening point obtained in Example 11. The length of the segment shown below the photograph corresponds to 10 μm.

Then, the second step and the successive step and treatments were conducted as follows: As an extracting solvent, 100 ml of n-butanol was used. While the solvent was stirred at room temperature by a magnetic stirrer, 10 ml of the emulsion prepared above was added to the solvent and the mixture was stirred further for 10 minutes. The mixture was filtered, washed, and dried in the same manner as in Example 1, thereby obtained ochre pitch fine particles as the aimed product. The pitch fine particles thus obtained had a softening point of 160° C., and a weight loss by heating up to 300° C. of 7.0% by weight. The yield of the fine particles based on the raw material naphtha cracking tar was 51% by weight. When the fine particles were examined by a scanning electron microscope, it was found that the particles were fine spherical particles having maximum diameter of about 40 μm. FIG. 3 is a scanning electron microscopic photograph of the fine spherical particles of the high softening point pitch obtained in this example.

EXAMPLE 12

Firstly, a soft pitch was obtained by distilling a coal tar. A purified coal tar pitch was prepared by dissolving the soft pitch in a twice amount of xylene, filtering the solution to remove insoluble components contained therein, and removing xylene from the solution of soluble components by distillation. By using the purified coal tar pitch, the first step was conducted as follows: Into a glass flask, 100 g of the purified coal tar pitch and 20 g of polyoxyethylene alkylphenyl ether (Emuljet 161; tradename, Daiichi Kogyo Seiyaku K.K.) as a nonionic surface-active agent were charged, and the glass flask was heated to 85° C. While the content of the flask was agitated by the homogenizer used in Example 7 at a rotation rate of 5,000 rpm, 180 ml of hot water kept at 85° C. was gradually added to the mixture and agitation was continued for 3 minutes. Thus, an emulsion of the purified coal tar pitch and the nonionic surface-active agent in the hot water was obtained. The emulsion was, then, cooled to room temperature. Incidentally, the purified coal tar pitch had a weight loss by heating up to 300° C. of 29.0% by weight, and a viscosity at 85° C. of 3.7 poise.

Elemental analysis: C: 93.2 wt. %, H: 5.6 wt. %, S: 0.60 wt. %

Then, the second step and the successive step and treatments were conducted as follows: As a extracting solvent, 100 ml of acetone was used. Into the solvent stirred by a magnetic stirrer at a room temperature, 10 ml of the emulsion prepared above was added to the solvent and stirring was continued further for 10 minutes. The mixture thus obtained was filtered, washed, and dried in the same manner as in Example 1, thereby obtained blackish brown pitch fine particles as the aimed product. The aimed product, i.e., pitch fine particles had a softening point of 280° C., and a weight loss by heating up to 300° C. of 0.9% by weight. The yield of the particles based on the raw material purified coal tar pitch was 17% by weight. When the particles were examined by a scanning electron microscope, it was found that the fine particles were fine spherical particles having maximum diameter of about 20 μm.

COMPARATIVE EXAMPLE 1

A pitch solution was prepared by dissolving 6 g of pitch used in Example 1in 4 g of xylene. The pitch solution per se was directly added at room temperature to 100 ml of n-butanol while stirring with an ultrasonic vibrator and a screw-type agitator and the mixture was stirred further for 10 minutes. That is, in this example, the first step, i.e., emulsification by the use of water, was not conducted. Then, the mixture was filtered and washed in the same manner as in Example 1 to obtain pitch fine particles. When the pitch fine particles were observed by an optical microscope, it was found that the fine particles were a mixture of particles with distorted shapes having diameters ranging from several tens μm to several hundreds μm. When the fine particles were dried in a dryer kept at 110° C., the particles were melted and fused together to form lumps.

COMPARATIVE EXAMPLE 2

In the two experiments conducted in this example, as extracting solvent, n-pentane or cyclohexane was used, respectively, both of n-pentane and cyclohexane are solvents which cannot dissolve water. In each experiment, into 100 ml of the solvent, while stirring with a magnetic stirrer at room temperature, 10 ml of the emulsion obtained in Example 6 was added, respectively. The stirring was continued further for 10 minutes, and then the mixture was kept stand. Thus, the mixture was separated into three layers, i.e., the bottom layer was a water layer colored yellowish, the middle layer was a scum-like tacky dough layer which was believed to be a mixture of the pitch solution, water, and the solvent commingled with each other, and the upper layer was a solvent layer colored yellowish. The mixture of the three layers was tried to subject filtration as in Example 1, but filtration could not be carried out due to the clogging of filter. Accordingly, as another way for separation, the mixture of the three layers was put into a centrifuge tube, and the mixture was tried to separate by a centrifuge operation at 5,000 rpm, but the mixture was still maintained three layers and pitch fine particles could not be separated.

COMPARATIVE EXAMPLE 3

The purified coal tar pitch obtained in Example 12 was heat-treated at 500° C. by using a tubular heater. The heat-treated material thus obtained was dissolved in a twice amount of xylene and the insolubles formed by the heat treatment were removed by filtration. By distilling off of xylene from the filtrate, soluble component of the heat-treated material was obtained. The soluble component thus obtained was heat-treated by dispersing the soluble component in a gas stream as fine oil droplets, and bringing the dispersed fine oil droplets into contact with an inert gas in accordance with the disclosure given in U.S. Pat. No. 5,091,072. Thus, an isotropic pitch having a softening point of 215° C., a quinoline insoluble content of 0.1% by weight, and a xylene insoluble content of 60% by weight was obtained.

Elemental analysis of the isotropic pitch: C: 93.7 wt. %, H: 4.6 wt. %, S: 0.38 wt. %

A pitch solution was prepared by dissolving 50 g of the isotropic pitch in 50 g of quinoline. Emulsification of the isotropic pitch was tried by gradually adding an aqueous solution containing 2% by weight of a nonionic surface-active agent (Emulgen 985) into the pitch solution maintained at about 40° C. while agitating by the use of the homogenizer used in Example 7 rotating at a rate of 5,000 rpm. As the addition of the aqueous solution of the nonionic surface-active agent was proceeded, the viscosity of the system was concomitantly increased and at the same time, the rotation rate of the homogenizer was decreased parallel to the addition of the aqueous solution. Finally, the rotating blade was stopped due to the overload. At that time, the content of the system was examined and found that the pitch solution was changed to a very viscous material like a paste and emulsification by the use of a homogenizer was totally impossible.

REFERENCE EXAMPLE 1

The pitch fine spherical particles having a softening point of 258° C. obtained in Example 1 using acetone (Experiment 3) as the extracting solvent were put on a differencial thermobalance and were heated up to 275° C. in air at a temperature increasing rate of 2° C./minute. Thus, the pitch fine spherical particles were rendered infusible in an air atmosphere. The atmosphere was changed to nitrogen at the temperature, i.e., 275° C. and the replacement of air with nitrogen was continued for 30 minutes. Then, the pitch fine spherical particles were heated up to 1,000° C. by increasing the temperature in a rate of 10° C./minute. When the particles thus obtained was examined by a scanning electron microscope, it was found that the particles were carbon fine spherical particles which had been carbonized keeping the original spherical shape.

REFERENCE EXAMPLE 2

The pitch fine spherical particles having a softening point of 167° C. obtained in Example 3 were put into a 8N aqueous solution of nitric acid and the mixture was agitated for 1 hour maintaining at 100° C. by heating. The mixture was neutralized with an aqueous solution of NaOH. Pitch fine particles were recovered by filtration of the neutralized mixture through a glass filter. The pitch fine particles were thoroughly washed with water and dried at 110° C. The dried fine particles were put on a differencial thermobalance and were heated up to 1,000° C. at a temperature increasing rate of 10° C./minute in a nitrogen gas stream. When the fine particles thus obtained were examined by a scanning electron microscope, it was found that the particles were carbon fine spherical particles which had been carbonized keeping the original spherical form.

We claim:

1. A process for manufacturing fine particles of pitch with a high softening point comprising:

a first step of stirring a raw material heavy oil in the presence of a surface-active agent capable of dispersing the raw material heavy oil and water by employing stirring means which provides a shearing force to produce an emulsion with fine spherical particles having a size of 100 μm or less dispersed in water, wherein the raw material heavy oil is a liquid having a viscosity of 1,000 poise or less when stirred;

a second step of causing the emulsion obtained in the first step to come into contact with an extracting organic solvent which can dissolve water and is capable of leaving at least 10% by weight of the raw material heavy oil as an insoluble portion to extract and remove light components from the fine spherical particles of the raw material heavy oil in the emulsion, thereby converting fine particles of the raw material heavy oil to fine particles of pitch with an increased softening point; and a third step comprising separating and recovering fine particles of pitch with an increased softening point by a solid-liquid separation means from the liquid mixture of the emulsion and the extracting organic solvent obtained in the second step.

2. The process according to claim 1, wherein when a diluting organic solvent is used in the first step, the diluting organic solvent is mutually insoluble with water and capable of dissolving 90% by weight or more of the raw material heavy oil, and is at least one organic solvent selected from the group consisting of benzene, toluene, xylene, ethylbenzene, carbon tetrachloride, chloroform, trichloroethylene, tar gas oil or carbonyl oil obtained from coal tar, and gasoline fraction or gas oil produced by naphtha cracking.

3. The process according to claim 1, wherein the extracting organic solvent is at least one organic solvent selected from the group consisting of methyl ethyl ketone, acetone, methanol, ethanol, n-propanol, iso-propanol, n-butanol, and sec-butanol.

4. The process according to claim 1, wherein the raw material heavy oil used in the first step is a liquid having a viscosity of 1,000 poise or less without being conditioned.

5. The process according to claim 4, wherein when a diluting organic solvent is used in the first step, the diluting organic solvent is mutually insoluble with water and capable of dissolving 90% by weight or more of the raw material heavy oil, and is at least one organic solvent selected from the group consisting of benzene, toluene, xylene, ethylbenzene, carbon tetrachloride, chloroform, trichloroethylene, tar gas oil or carbonyl oil obtained from coal tar, and gasoline fraction or gas oil produced by naphtha cracking.

6. The process according to claim 4, wherein the extracting organic solvent is at least one organic solvent selected from the group consisting of methyl ethyl ketone, acetone, methanol, ethanol, n-propanol, iso-propanol, n-butanol, and sec-butanol.

7. The process according to claim 4, wherein the manner of contact of the emulsion and the extracting organic solvent is a method of adding the emulsion to the extracting organic solvent.

8. The process according to claim 1, wherein the raw material heavy oil is conditioned in the first step to become a liquid with a viscosity of 1,000 poise or less by a method of heating, a method of diluting or dissolving with a diluting organic solvent which is mutually insoluble with water and capable of dissolving 90% by weight or more of the raw material heavy oil, or a combination of these two methods.

9. The process according to claim 8, wherein the raw material heavy oil used in the first step is conditioned into a liquid having a viscosity of 1,000 poise or less by a method of heating.

10. The process according to claim 9, wherein the extracting organic solvent is at least one organic solvent selected from the group consisting of methyl ethyl ketone, acetone, methanol, ethanol, n-propanol, iso-propanol, n-butanol, and sec-butanol.

11. The process according to claim 8, wherein the raw material heavy oil used in the first step is conditioned into a liquid having a viscosity of 1,000 poise or less by a method of diluting or dissolving with the diluting organic solvent.

12. The process according to claim 11, wherein the diluting organic solvent is at least one organic solvent selected from the group consisting of benzene, toluene, xylene, ethylbenzene, carbon tetrachloride, chloroform, trichloroethylene, tar gas oil or carbonyl oil obtained from coal tar, and gasoline fraction or gas oil produced by naphtha cracking.

13. The process according to claim 11, wherein the extracting organic solvent is at least one organic solvent selected from the group consisting of methyl ethyl ketone, acetone, methanol, ethanol, n-propanol, iso-propanol, n-butanol, and sec-butanol.

14. The process according to claim 11, wherein the manner of contact of the emulsion and the extracting organic solvent is a method of adding the emulsion to the extracting organic solvent.

15. The process according to claim 8, wherein the raw material havy oil used in the first step is conditioned into a liquid having a viscosity of 1,000 poise or less by a combination of the method of heating and the method of diluting or dissolving with the diluting organic solvent.

16. The process according to claim 15, wherein the diluting organic solvent is at least one organic solvent selected from the group consisting of benzene, toluene, xylene, ethylbenzene, carbon tetrachloride, chloroform, trichloroethylene, tar gas oil or carbonyl oil obtained from coal tar, and gasoline fraction or gas oil produced by naphtha cracking.

17. The process according to claim 15, wherein the extracting organic solvent is at least one organic solvent selected from the group consisting of methyl ethyl ketone, acetone, methanol, ethanol, n-propanol, iso-propanol, n-butanol, and sec-butanol.

18. The process according to claim 2, wherein the extracting organic solvent is further defined as being able to remove any diluting organic solvent existing in the raw material heavy oil in the emulsion.

* * * * *